US005714931A

United States Patent [19]

Petite et al.

[11] Patent Number: 5,714,931

[45] Date of Patent: Feb. 3, 1998

[54] PERSONALIZED SECURITY SYSTEM

[76] Inventors: Thomas D. Petite, 6586 Oakwood Dr., Douglasville, Ga. 30135; J. W. Hosmer, 5405 Mount Vernon Pkwy., Atlanta, Ga. 30327

[21] Appl. No.: 605,649

[22] Filed: Feb. 22, 1996

Related U.S. Application Data

[63] Continuation of Ser. No. 243,263, May 16, 1994, abandoned.

[51] Int. Cl.[6] ..... G08B 1/08

[52] U.S. Cl. ..... 340/539; 340/573; 340/531; 340/825.72; 340/825.49; 455/54.2

[58] Field of Search ..... 340/825.49, 573, 340/574, 539, 825.72, 531; 455/54.2

[56] References Cited

U.S. PATENT DOCUMENTS

| | | | |
|---|---|---|---|
| 3,665,475 | 5/1972 | Gram | 343/225 |
| 3,723,876 | 3/1973 | Seaborn, Jr. | 325/64 |
| 3,914,692 | 10/1975 | Seaborn, Jr. | 325/53 |
| 3,925,763 | 12/1975 | Wadhwani et al. | 340/164 R |
| 4,083,003 | 4/1978 | Haemmig | 325/6 |
| 4,446,454 | 5/1984 | Pyle | 340/538 |
| 4,495,496 | 1/1985 | Miller | 340/825.49 |
| 4,952,928 | 8/1990 | Carroll et al. | 340/825.54 |
| 4,998,095 | 3/1991 | Shields | 340/825.49 |
| 5,055,851 | 10/1991 | Sheffer | 342/457 |
| 5,086,391 | 2/1992 | Chambers | 340/573 |
| 5,115,224 | 5/1992 | Kostusiak | 340/825.49 |
| 5,159,317 | 10/1992 | Brav | 340/574 |
| 5,162,776 | 11/1992 | Bushnell | 340/531 |
| 5,204,670 | 4/1993 | Stinton | 340/825.54 |
| 5,223,844 | 6/1993 | Mansell et al. | 342/357 |
| 5,334,974 | 8/1994 | Simms et al. | 340/990 |
| 5,365,217 | 11/1994 | Toner | 340/539 |

FOREIGN PATENT DOCUMENTS 2247761 11/1992 United Kingdom .

*Primary Examiner*—Jeffery Hofsass
*Assistant Examiner*—Albert K. Wong
*Attorney, Agent, or Firm*—Troutman Sanders LLP; Joel S. Goldman

[57] ABSTRACT

The present invention relates to a personalized security system, in which a portable transmitter may be carried or worn by an individual and activated by the individual in need of assistance to transmit data relating specifically to the individual. The data is received by a transceiver located nearby to the individual and transmitted with additional data to a remote receiver. The remote receiver then forwards information relating to the data to emergency personnel who use the information to determine the location of the individual, as well as particulars relating specifically to the individual, such as a name and a physical description.

10 Claims, 4 Drawing Sheets

PERSONALIZED SECURITY SYSTEM

This is a continuation of application Ser. No. 08/243,263, filed on May 16, 1994, abandoned.

BACKGROUND OF INVENTION

1. Technical Field

The present invention relates to security systems. More specifically, the present invention relates to a personalized security system, in which a portable transmitter may be carried or worn by an individual and activated by the individual in need of assistance to transmit data relating specifically to the individual. The data is received by a transceiver located nearby to the individual and transmitted with additional data to a remote receiver. The remote receiver then forwards information relating to the data to emergency personnel who use the information to determine the location of the individual, as well as particulars relating specifically to the individual, such as a name and a physical description.

2. Description of the Prior Art

Emergency type situations, such as burglaries, fires, and sickness, have previously given rise to the introduction of a variety of remote emergency warning systems. In particular, many homeowners use security systems which are installed in the home and can be remotely monitored. These systems typically have the ability to indicate the type of assistance needed, such as the police, fire department, or an ambulance and the location of the home. A drawback to these systems is that they are of no use once the individual leaves his or her home.

Modern day trends show an increase in random acts of violence, such as robberies, assaults, and batteries. For this reason, personal remote emergency warning systems have also been introduced. These systems typically allow an individual to carry or wear a transmitter which may be manually or automatically activated when the individual encounters an emergency type situation. Once activated, the transmitter typically sends a signal containing information identifying the particular transmitter and the nature of the emergency to a remote transceiver which forwards the information to emergency personnel.

A drawback to these latter systems is that no data relating specifically to the individual is transmitted by the transmitter. Therefore, though emergency personnel could identify the transmitter and the nature of the emergency, no information regarding the user, such as the name of the user, the description of the user, the user's vehicle tag number, and the like, is immediately available to the emergency personnel. Due to this inadequacy, precious time may be wasted as the emergency personnel arrives at the scene of an emergency with no information regarding the individual they have arrived to assist.

SUMMARY OF THE INVENTION

In accordance with the teachings of the present invention, a new system for personalized security is provided. The present invention overcomes the inadequacies of prior art personalized security systems by providing a means for data related specifically to a user of the system to be transmitted to emergency personnel when assistance is needed. For example, an individual at an Automated Teller Machine (ATM) could notify the police of a robbery at the ATM as it is occurring, where the notice to the police could include the location of the crime, the individual's name, a description of the individual, the individual's vehicle tag number and much more. By having this information immediately accessible, the police could then more precisely and efficiently act to rescue the individual.

The system includes a portable transmitter, a transceiver, and a remote receiver. The portable transmitter sends a signal containing the personalized data to a nearby transceiver, the transceiver forwards the data to a remote receiver, and the remote receiver forwards the data to the emergency personnel.

The portable transmitter is a hand held unit, which may be very small such that it is easily carried in an individual's pocket or on a key ring. The personal transmitter preferably transmits an FSK tone modulation signal to the transceiver, where the signal contains data relating to a distinct user identification code. In addition, the signal may also include other data specific to the individual such as the individual's name, address, description, vehicle tag number, vehicle identification number, LOJACK car number, nearest relative, and much more.

The transceiver receives the data from the portable transmitter, decodes the data, and adds data related to the location of the transceiver. The transceiver then transmits the data to the remote receiver, preferably over a telephone line via a modem. The location of the transceiver is anywhere in the proximate area to where the individual activates the personal transmitter. For example, the transceiver may be located in an ATM or in a building such as a grocery store, in the vicinity of the individual.

The remote receiver receives the data and uses a database to obtain any further data relating to the user and to obtain information on the emergency personnel closest to the location of the transceiver. The remote receiver then transmits the data to the emergency personnel identified from the database, such as the closest police department. The emergency personnel may then provide more efficient and precise assistance to the individual activating the system due to the personalized data.

One example of a situation in which the personalized security system of the present invention would provide improved security is a robbery and kidnapping situation at an ATM. For instance, if a user is attacked at an ATM, the user may activate the system, and emergency personnel may be quickly notified of the particulars on the user. Therefore, the police may be notified to be on the lookout for an individual and a car meeting certain descriptions. With this information, the police might catch the criminal driving off with the user, in the user's car, or both.

In another example, if a user incurred a medical problem in a crowded public area, medical personnel may be summoned quickly. The medical personnel may then arrive at the scene with information relating to the physical description and the medical condition of the individual in need of assistance.

The aforementioned and other aspects of the present invention are described in the detailed description and attached illustrations which follow.

DETAILED DESCRIPTION OF THE INVENTION

Figure 1:
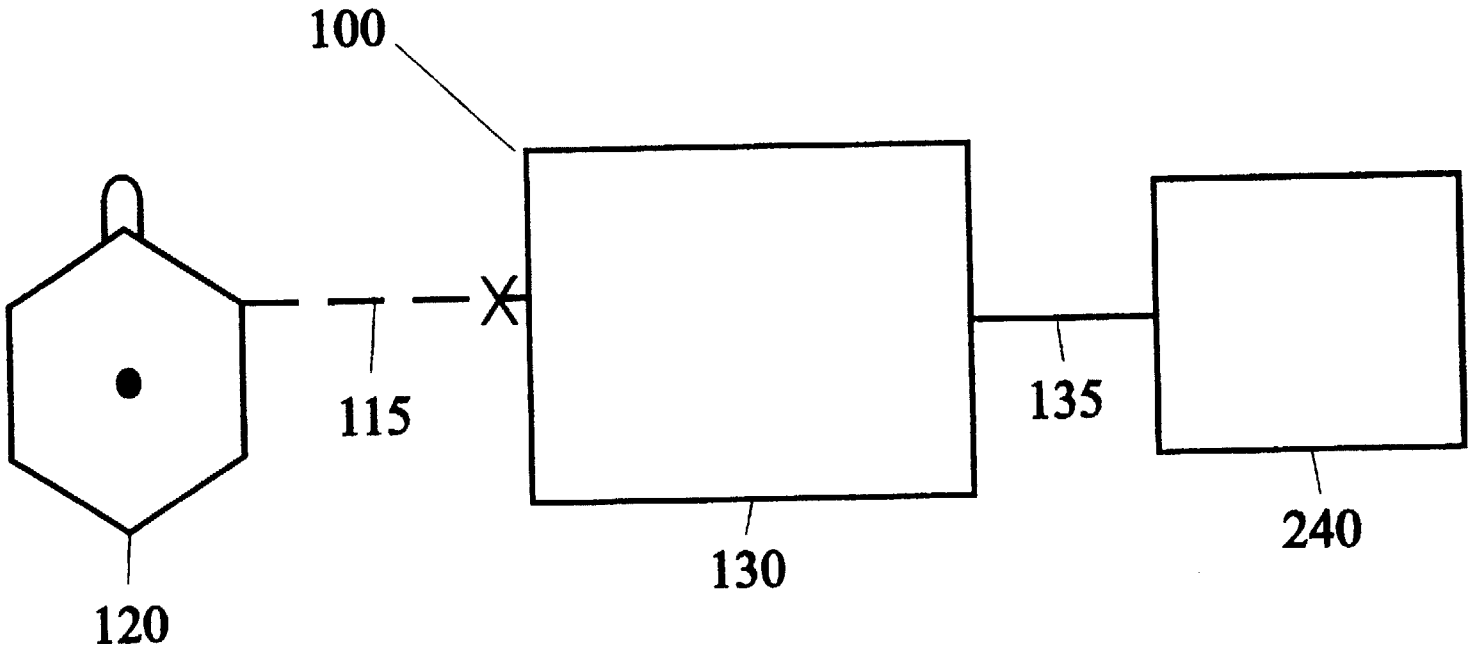
FIG. 1 depicts a block diagram illustrating the interaction between the portable transmitter device, the transceiver, and the remote receiver.
Figure 2:
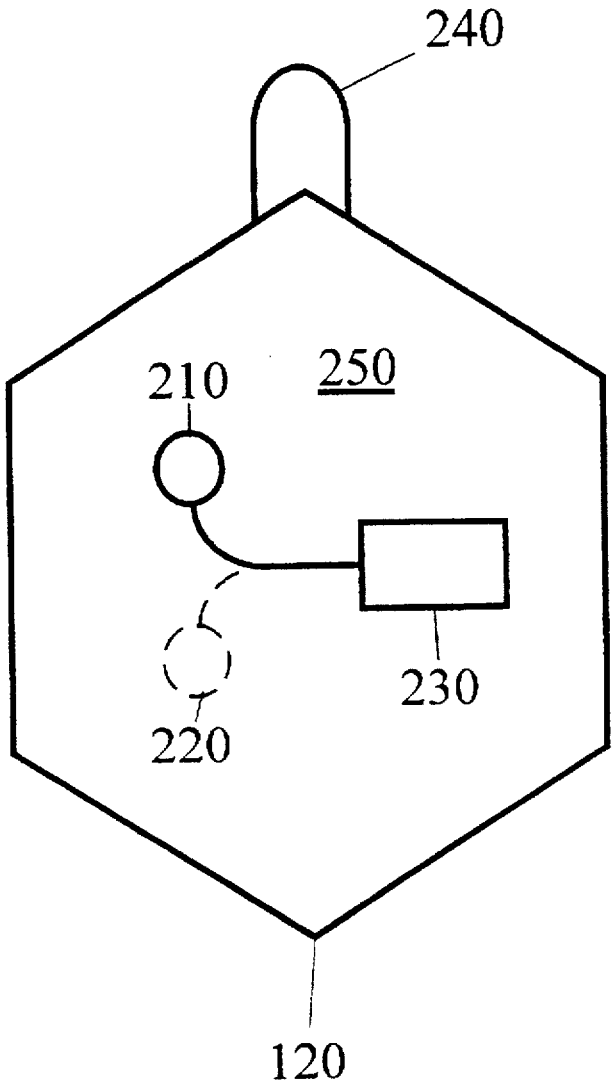
FIG. 2 depicts a block diagram of the portable transmitter device.

The following is a preferred implementation of the personalized security system 100 of the present invention as shown in FIG. 1. The system 100 includes a portable transmitter device 120, a transceiver 130, and a remote receiver 140. The portable transmitter device 120 transmits a signal 115 containing data specific to an individual to the transceiver 130. The signal is then decoded by the transceiver 130 and forwarded with additional data over a telephone line 135 to the remote receiver 140. Emergency personnel is then notified by the remote receiver 140 of the location and the particular individual needing assistance.

The portable transmitter device 120 is a hand held unit which may be carried or worn by an individual. In one embodiment, the portable transmitter device 120 is encompassed in a plastic housing 250. A ring 240 may be mounted to the plastic housing 250 such that an individual may carry the portable transmitter device 120 on a key ring.

In one embodiment, the portable transmitter device 120 includes a top button 210 and bottom button 220 which are mounted on the top and bottom or other opposed sides of the plastic housing 250, respectively. The buttons 210 and 220 are wired to a transmitter 230 located within the portable transmitter device 120. When the two buttons 210 and 220 are pressed simultaneously by the user, the transmitter 230 is activated.

In a second embodiment, the portable transmitter includes two or more top buttons 210 and one bottom button 220. In this embodiment, each of the top buttons represents a particular emergency type condition. For example, the first top button 210 could represent that police assistance is needed and the second top button 210 could represent that medical assistance is required. While it is impossible to describe every conceivable type of emergency condition in which the present invention may be used, other top buttons 210 could represent a fife or automobile trouble. When a top button 210 and bottom button 220 are then pressed simultaneously, the transmitter is activated and a signal containing the type of emergency condition is sent to the transceiver 130 (see FIG. 1).

Though the simultaneous pressed button configuration for activating the transmitter is described for the two embodiments, those of ordinary skill in the art would appreciate that there are many other equivalent means that could be used for the same purpose.

The transmitter 230 transmits an FSK tone modulation signal 115 (see FIG. 1), similar to that of a cellular phone, which preferably reaches a minimum of 150 feet away. In one embodiment, the signal transmitted contains a distinct identification code for the user. The PT-2D portable transmitter device available from Transcience of Stamford, Conn. may be utilized to transmit up to 65,536 distinct four digit codes to identify the user. The PT-2D uses dip switches located on the exterior of the portable transmitter device 120 to set the user identification code.

In another embodiment, the portable transmitter device 120 includes a Read Only Memory (ROM) device in which the user identification code is programmed into it. This embodiment improves on the PT-2D because the number of user identification codes for the personalized security system of the present invention is no longer limited by the number of dip switches. Further, the user no longer has the capability of purposefully or accidentally, flipping a dip switch thereby sending an improper user identification code when the portable transmitter device 120 is activated.

In yet another embodiment, the transmitter 230 transmits the signal containing two or more data elements stored on a ROM where the data elements are specific to the user. These data elements may include as the user's identification code, name, address, description, digitized picture, medical condition, vehicle tag number, vehicle identification number, LOJACK number, nearest relative or friend, and much more.

Though preferred embodiments for transmitting a signal with data related specifically to the user are described, one of ordinary skill in the art would appreciate that other types of transmitters may be used. For example, a transmitter that transmits a satellite signal, and a transmitter that transmits billions of distinct codes to identify different users may be used in the personalized security system of the present invention.

The transceiver 130 receives the data from the portable transmitter, decodes the data, and adds data related to the location of the transceiver 130. The data is then transmitted by the transceiver 130 to the remote receiver 140.

In one embodiment, the transceiver 130 includes an antenna 305, a receiver/decoder 310, an interface unit 320, a central processing unit (CPU) 330, a modem 340, and a battery pack 350. For external mountings, the transceiver 130 components may be housed in a metal box or any other housing that accommodates electrical components. For internal mountings, such as a computer or ATM, the transceiver components may be manufactured onto a small circuit board.

The signal sent by the portable transmitter device 120 is received by the antenna 305. The antenna 305 is coupled to the receiver/decoder 310 and is capable of receiving a FSK tone modulation signal.

In one embodiment, referred to as the remote antenna embodiment, the antenna 305 is mounted to the top of a structure, such as a grocery store, and wiring, such as coaxial cable, is used to connect the antenna 305 to the receiver/decoder 310. In a second embodiment, referred to as the solid mount embodiment, the antenna is mounted to the transceiver box housing the components of the transceiver, and wiring is used to couple the antenna 305 to the receiver/decoder 310.

The receiver/decoder 310 receives the signal 115 (see FIG. 1) from the antenna 305. The data within the signal 115 is then decoded by the receiver/decoder 310 and forwarded to the interface unit 320.

The interface unit 320 receives the data from the receiver/decoder 310 and conditions the data for the CPU 330. The data is then forwarded by the interface unit 320 to the CPU 330.

The CPU 330 includes memory capacity to store at least 65,536 four digit user identification codes, but preferably billions of user codes. These user codes are downloaded from the remote receiver 140 (see FIG. 1) as users are added and deleted to the system. The user identification code forwarded from the interface unit 320 is then verified against the user identification codes stored in the CPU 330. If the user identification code is confirmed and validated, then the CPU 330 appends a location code to the conditioned data which identifies the location of the transceiver 130. The CPU then forwards the conditioned data to the modem and commands the modem 340 to dial up the remote receiver 140.

The modem 340 is a standard telephone modem. Once the modem receives the conditioned data and the command to dial the remote receiver 140 from the CPU, the modem transmits a "Request for Assistance" over a telephone line 135 to the remote receiver 140. After the modem 340 receives an acknowledgement from the remote receiver 140, the modem 340 transmits the conditioned data to the remote receiver 140 over the telephone line 135.

The RT-232 receiver/decoder device available from Transceiver, which recognizes up to 65,536 distinct codes, may be used for the transceiver. However, as one of ordinary skill in the art would appreciate, an equivalent device or one which recognizes billions of distinct user codes could also be used. Also, it would be readily understood by one of ordinary skill in the art that the transceiver 130 may communicate with the remote receiver 140 over many equivalent means other than telephone lines, such as cellular and satellite links.

In a second embodiment, the CPU 330 of the transceiver 130 also includes memory capacity to store data elements for different users. The transceiver 130 then uses the data, such as the user identification code or any other data element related to the user, received from the portable transmitter device 120 and database software to obtain additional data in connection with the user. This data may include information related specifically to characteristics of the user, such as size, weight, height, hair color, eye color, birth marks, age, medical condition and race. Moreover, this data may include information of the user's vehicle, such as type, model, year, color, tag, identification number, and LOJACK number. Further, the data may include information on the user's nearest relatives and friends and much more user specific information. The CPU 330 may then append the additional data to the conditioned data and forward all of the data to the remote receiver 140.

The transceiver 130 is located a distance in close proximity to where the user activates the portable transmitter device 120, preferably within 150 feet. The structure for locating the transceiver 130 may be almost any structure, including an automatic teller machine (ATM), a grocery store, or the like. The transceiver 130 may be mounted on a wall, floor or almost anywhere else. The structure that the transceiver 130 is located preferably includes a 110 volt electrical outlet and a telephone line.

The transceiver 130 preferably runs off of 110 volts. However, a battery pack trickle charger battery pack 350 is also included in the transceiver 130 to provide backup power for power outages instances. In one embodiment, the battery pack 350 provides 12 volts, 12 amps, and 24 hours of power. In another embodiment, the battery pack 350 provides 12 volts, 15 amps, and 48 hours of power.

The remote receiver 140 is a computer which includes a modem 410 and a CPU 420. The remote receiver 140 uses database software and the CPU 420 to store further data related specifically to the users of the system, as well as data related to emergency personnel.

The remote receiver 140 receives the data from the transceiver 130 over the telephone line via the modem 410, and uses the database software and the user's identification code or any other data element related to the user to obtain further information in connection with the user. This information may include information related specifically to characteristics of the user, such as size, weight, height, hair color, eye color, birth marks, age, medical condition and race. Moreover, this information may include information of the user's vehicle, such as type, model, year, color, tag, identification number, and LOJACK number. Further, the information may include the user's nearest relatives and friends and much more user specific information. Finally, the location identifier data element for the transceiver may be used to obtain information from the database on the address of where the transceiver 130 (see FIG. 1) is located, the cross streets nearest to the transceiver 130, and the emergency personnel, such as the police department, fire department, and ambulance, closest to the transceiver 130.

The remote receiver 140 then uses the modem 410 to notify the emergency personnel closest to the transceiver 130 about the user in need of assistance. During the notification process, the information relating specifically to the user who activated the portable transmitter device 120 (see FIG. 1) is sent to the emergency personnel. The emergency personnel is then able to provide more efficient and precise assistance to the user of the personalized security system of the present invention. As one of ordinary skill in the art would appreciate, the remote receiver 140 may communicate with the emergency over many equivalent means, such as cellular and satellite links. Moreover, communication with emergency personnel may include direct communication with police officers in their cars, firemen in their fire trucks and many others with access to communication links.

Figure 3:
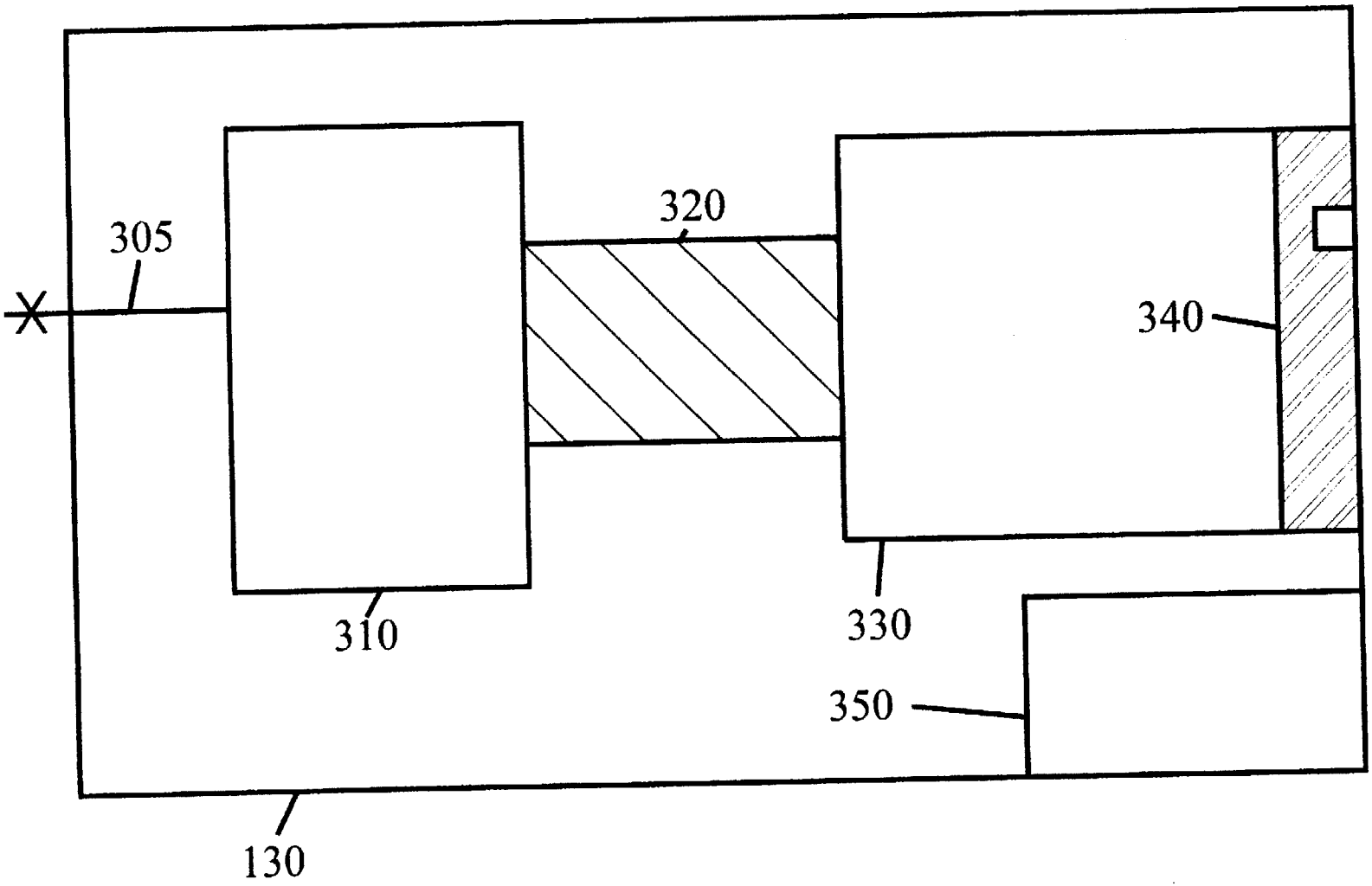
FIG. 3 depicts a block diagram of the transceiver.
Figure 4:
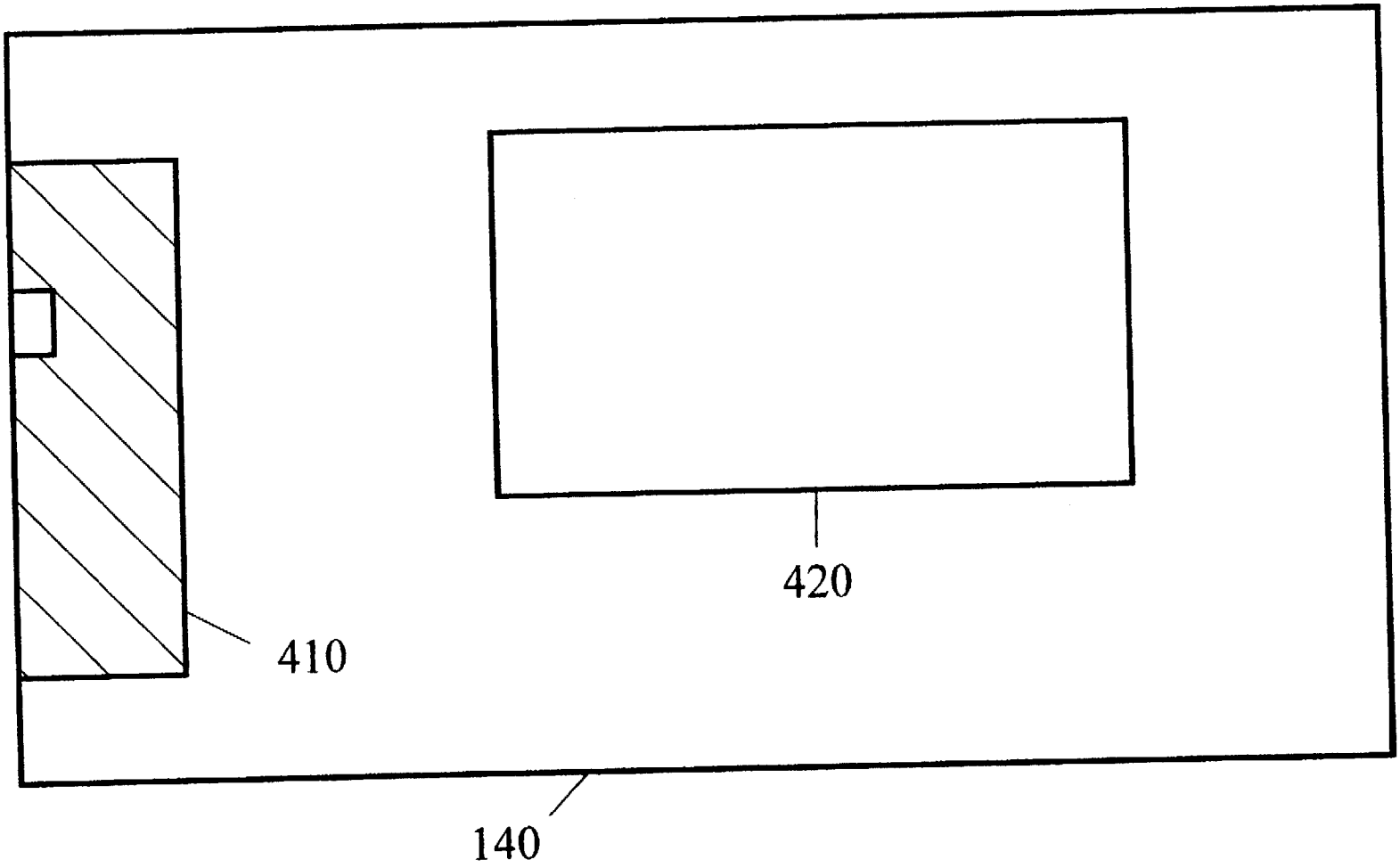
FIG. 4 depicts a block diagram of the remote receiver.

In addition to identifying pertinent user information and notifying emergency personnel, the remote receiver 140 may store the time, date, and location of the transceiver 130 (see FIG. 1) for each instance the personalized security system is activated. Further, activated and deactivated user identification numbers may be downloaded by the remote receiver 140 to the CPU 330 of the transceiver 130 (see FIG. 3). Moreover, the remote receiver 140 may perform random operation checks on the transceiver 130.

We claim:

1. For use in combination with a self-service bank transaction facility, an assistance procuring system comprising:

a totable transmitter including means for activation by a user, and means responsive to said activation means for transmitting a first signal, said first signal being encoded to uniquely identify the transmitter;

a transceiver installed in close proximity to the self-service bank transaction facility including means for receiving said first signal, and means for transmitting a second signal encoded to include transceiver location information and transmitter identification information derived from said first signal;

a remote station including a database having a plurality of updateable data elements including personal information relating to the user, the remote station further including means responsive to the second signal for indexably retrieving one or more of the data elements.

2. The assistance procuring system of claim 1, wherein one or more of the plurality of data elements are selected from the group consisting of:

(a) the user's address;

(b) a description of the user;

(c) a digitized picture of the user;

(d) the user's vehicle tag number;

(e) the user's vehicle identification number;

(f) the user's vehicle LOJACK number;

(g) the user's nearest relatives or friends;

(h) the addresses of the user's nearest relative or friend;

(i) medical information of the user;

(j) an I.D. number assigned to the user; and (k) the user's name.

3. The system of claim 1 wherein said database includes one or more updateable elements relating to emergency personnel in the vicinity of said transceiver.

4. The assistance procuring system of claim 1 wherein said totable transmitter includes a memory device adapted to store data for producing said encoded signal.

5. The assistance procuring system of claim 1, wherein the totable transmitter further includes means for transmitting a set of one or more data elements representative of the nature of the assistance needed.

6. For use in an assistance procuring system for a bank self-service facility, said system including a totable transmitter adapted to transmit a first signal containing a first set of one or more data elements representative of personal information relating to a user, and a transceiver located in close proximity to the bank self-service facility and adapted to receive said first signal and further adapted to transmit a second signal including said first set of said data elements and one or more additional data elements; a remote station comprising:

a memory device adapted to store a plurality of updateable data elements corresponding to personal information relating to the user;

means for receiving said second signal; and means for generating a third signal corresponding to said first set of said one or more data elements, said one or more additional data elements, and said plurality of data elements.

7. The remote station according to claim 6, wherein said plurality of data elements is organized in a searchable data base.

8. The remote station of claim 6 where said memory device is further adapted to store updateable information relating to emergency personnel located in the vicinity of said transceiver.

9. A method of procuring assistance, said method comprising the steps (a) accepting, at a totable transmitter, a first signal from a user, said signal indicating assistance is needed;

(b) transmitting a second signal from the totable transmitter to a transceiver located at a bank self-service facility, wherein said second signal includes user identifying information;

(c) transmitting a third signal from said transceiver to a receiver, wherein said third signal includes location identifying information;

(d) receiving said third signal from said transceiver at a remote station;

(e) accessing a storage device at the remote station retrieve a plurality of updateable data elements relating to the user; and (f) forwarding from the remote station a fourth signal corresponding to said plurality of data elements and the location of the transceiver.

10. The assistance procuring method of claim 9, wherein said plurality of updateable data elements is selected from the group consisting of:

(a) the user's address;

(b) a description of the user;

(c) a digitized picture of the user;

(d) the user's vehicle tag number;

(e) the user's vehicle identification number;

(f) the user's vehicle LOJACK number;

(g) the user's nearest relatives or friends;

(h) the addresses of the user's nearest relatives or friends;

(i) an ID number assigned to the user;

(j) medical information of the user; and (k) the user's name.

* * * * *